US009662876B2

(12) United States Patent
Yokota

(10) Patent No.: US 9,662,876 B2
(45) Date of Patent: May 30, 2017

(54) LIQUID EJECTING APPARATUS AND METHOD OF FORMING ADJUSTMENT PATTERN CHECK AREA

(71) Applicant: SEIKO EPSON CORPORATION, Tokyo (JP)

(72) Inventor: So Yokota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/263,968

(22) Filed: Sep. 13, 2016

(65) Prior Publication Data

US 2017/0072681 A1 Mar. 16, 2017

(30) Foreign Application Priority Data

Sep. 14, 2015 (JP) ..... 2015-180444

(51) Int. Cl.
*B41J 2/045* (2006.01)
*B41J 2/21* (2006.01)

(52) U.S. Cl.
CPC ..... *B41J 2/04505* (2013.01); *B41J 2/04586* (2013.01); *B41J 2/2132* (2013.01)

(58) Field of Classification Search
CPC ..... B41J 2/04505; B41J 2/2135; B41J 2/205; B41J 2/2132; B41J 19/145; B41J 2/07; B41J 2/145; B41J 2/04593; B41J 2/13
See application file for complete search history.

(56) References Cited

U.S. PATENT DOCUMENTS 6,322,191 B1 11/2001 Seshimo et al.
6,334,720 B1 1/2002 Kato et al.
2009/0058895 A1* 3/2009 Kida ..... B41J 25/308 347/8
2014/0028748 A1* 1/2014 Hudd ..... B41J 2/15 347/12
2016/0089883 A1 3/2016 Yokota
2016/0089918 A1 3/2016 Yokota

FOREIGN PATENT DOCUMENTS

JP 11-005301 A 1/1999
JP 2000-127360 A 5/2000
JP 2004-090327 A 3/2004
JP 2012-213909 A 11/2012
JP 2015-178202 A 10/2015
JP 2016-064620 A 4/2016
JP 2016-064622 A 4/2016
JP 2016-068435 A 5/2016

* cited by examiner

*Primary Examiner* — Thinh H Nguyen
(74) *Attorney, Agent, or Firm* — Foley & Lardner LLP

(57) ABSTRACT

An ejector is caused to eject a liquid such that first patterns are formed in a first direction on a medium while the ejector is moved outward, second patterns are formed in one-to-one correspondence with the first patterns with different first amounts of interval in the first direction from the first patterns while the ejector is moved backward, and a third pattern is formed in an end region that is at least a part of an end of the first patterns in the second direction and at least a part of an end of the second patterns in the second direction.

10 Claims, 8 Drawing Sheets

LIQUID EJECTING APPARATUS AND METHOD OF FORMING ADJUSTMENT PATTERN CHECK AREA

BACKGROUND

1. Technical Field

The present invention relates to a liquid ejecting apparatus and a method of forming an adjustment pattern check area.

2. Related Art

Liquid ejecting apparatuses, such as for ejecting a liquid, for example, ink, from a nozzle array of an ejector onto a medium such as a subject recording medium, have been used. Generally, such liquid ejecting apparatuses form an adjustment pattern and use the adjustment pattern to adjust the position of the liquid landing on the medium before ejecting the liquid onto the medium.

For example, JP-A-2000-127360 discloses a recording apparatus (a liquid ejecting apparatus) that adjusts the position of a liquid landing on a medium by using a linear pattern formed by a forward movement of an ejector and a linear pattern formed by a backward movement of the ejector.

In a recording apparatus configured to eject a liquid from a nozzle array, however, the speed of liquid ejection may deteriorate at an end of the nozzle array as disclosed, for example, in JP-A-2012-213909. Therefore, there may be a decrease in adjustment accuracy if the position of the liquid landing on the medium is adjusted with reference to a part of an adjustment pattern that has been formed by the end of the nozzle array. Thus, in the liquid ejecting apparatuses of the related art, there may be a decrease in the adjustment accuracy depending on the adjustment pattern check position.

SUMMARY

An advantage of some aspects of the invention is that a decrease in the adjustment accuracy depending on the adjustment pattern check position can be inhibited.

A liquid ejecting apparatus according to an aspect of the invention includes: an ejector having a nozzle array that ejects a liquid and that is capable of reciprocating in a first direction intersecting the nozzle array; a moving unit that moves a medium and the ejector relative to each other in a second direction intersecting the first direction; and a controller that causes the ejector to eject the liquid to form first patterns in the first direction on the medium while moving the ejector outward in the first direction, form second patterns in one-to-one correspondence with the first patterns with different first amounts of interval in the first direction from the first patterns while moving the ejector backward in the first direction, and form a third pattern in an end region that is at least a part of an end of the first patterns in the second direction and at least a part of an end of the second patterns in the second direction.

According to this aspect, the third pattern is formed in the end region that is at least a part of the end of the first patterns in the second direction and at least a part of the end of the second patterns in the second direction. With this, an adequate adjustment pattern check position can be recognized with reference to the third pattern. Thus, a decrease in the adjustment accuracy depending on the adjustment pattern check position can be inhibited.

Note that "the end region that is at least a part of the end of the first patterns in the second direction and at least a part of the end of the second patterns in the second direction" means a region in the end or adjacent to the end, rather than at the end, of the first patterns and the second patterns in the second direction; this may or may not include the end.

In the liquid ejecting apparatus according to the aspect of the invention, the third pattern may be a visibility decrease pattern which decreases visibility of the first patterns and the second patterns in the end region.

According to this aspect, the third pattern is a visibility decrease pattern which decreases visibility of the first patterns and the second patterns in the end region. Specifically, an inadequate adjustment pattern check position is covered with the third pattern. With this, a decrease in the adjustment accuracy depending on the adjustment pattern check position can be accurately inhibited.

In the liquid ejecting apparatus according to the aspect of the invention, the controller may cause the visibility decrease pattern to be formed in a color identical to at least one of a color of the first patterns and a color of the second patterns.

According to this aspect, the color of the visibility decrease pattern is the same as at least one of the color of the first patterns and the color of the second patterns. With this, an inadequate adjustment pattern check position can be securely covered with the third pattern.

In the liquid ejecting apparatus according to the aspect of the invention, the controller may cause the visibility decrease pattern to be formed as a line extending in the first direction.

According to this aspect, the visibility decrease pattern is formed as a line extending in the first direction. With this, an inadequate adjustment pattern check position can be covered by simply controlling the ejection.

In the liquid ejecting apparatus according to the aspect of the invention, the controller may form pattern groups each including two or more of the first patterns and two or more of the second patterns that correspond to each other and causes the visibility decrease pattern to be formed as a line for each of the pattern groups.

According to this aspect, the pattern groups each including two or more of the first patterns and two or more of the second patterns that correspond to each other are formed, and the visibility decrease pattern is formed as a line for each of the pattern groups. With this, the visibility decrease pattern allows corresponding patterns to be combined together as a pattern group, such that recognition of each pattern group can be made easier.

In the liquid ejecting apparatus according to the aspect of the invention, the controller may cause a mark to be formed for each pattern set including one of the first patterns and one of the second patterns that correspond to each other.

According to this aspect, a mark is formed for each pattern set including one of the first patterns and one of the second patterns that correspond to each other. Thus, for example, with a configuration in which a user selects a desired pattern from among two or more of the first patterns and two or more of the second patterns that correspond to each other and inputs the selected pattern by using a user interface or the like, the user can easily recognize and input the desired pattern in association with the mark.

In the liquid ejecting apparatus according to the aspect of the invention, the controller may cause the third pattern to be formed such that at least one of the first pattern and the second pattern protrudes toward the mark through the third pattern.

According to this aspect, the third pattern is formed such that at least one of the first pattern and the second pattern protrudes toward the mark through the third pattern. With this, the correspondence between a desired pattern and a mark can be easily recognized.

In the liquid ejecting apparatus according to the aspect of the invention, the first patterns and the second patterns may be equal in length in the second direction.

According to this aspect, the first patterns and the second patterns are equal in length in the second direction. With this, the amounts of ink ejected for the first patterns and the second patterns can be equalized, allowing for a reduction of errors in the ink-landing position for forming the adjustment pattern which are due to variations in the amount of ink ejected for the first patterns and the second patterns.

Note that "equal" herein means substantially the same or substantially equal, in other words, it is not necessary to be exactly equal.

In the liquid ejecting apparatus according to the aspect of the invention, each pattern set, which includes one of the first patterns and one of the second patterns that correspond to each other, may have point symmetry.

According to this aspect, each pattern set including one of the first patterns and one of the second patterns that correspond to each other has point symmetry. With this, simple patterns that are easy for users to see can be made.

A method of forming an adjustment pattern check area according to an aspect of the invention is a method of forming an adjustment pattern check area by using a liquid ejecting apparatus including: an ejector having a nozzle array that ejects a liquid and that is capable of reciprocating in a first direction intersecting the nozzle array; and a moving unit that moves the medium and the ejector relative to each other in a second direction intersecting the first direction. This method includes causing the ejector to eject the liquid to: form first patterns in the first direction on the medium while moving the ejector outward in the first direction; form second patterns in one-to-one correspondence with the first patterns with different first amounts of interval in the first direction from the first patterns while moving the ejector backward in the first direction; and form a third pattern in an end region that is at least a part of an end of the first patterns in the second direction and at least a part of an end of the second patterns in the second direction.

According to this aspect, the third pattern is formed in the end region that is at least a part of the end of the first patterns in the second direction and at least a part of the end of the second patterns in the second direction. With this, an adequate adjustment pattern check position can be recognized with reference to the third pattern. Thus, a decrease in the adjustment accuracy depending on the adjustment pattern check position can be inhibited.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus serving as a liquid ejecting apparatus according to an embodiment of the invention will be described with reference to the drawings.

First, an outline of a recording apparatus according to an embodiment of the invention will be given.

Figure 1:
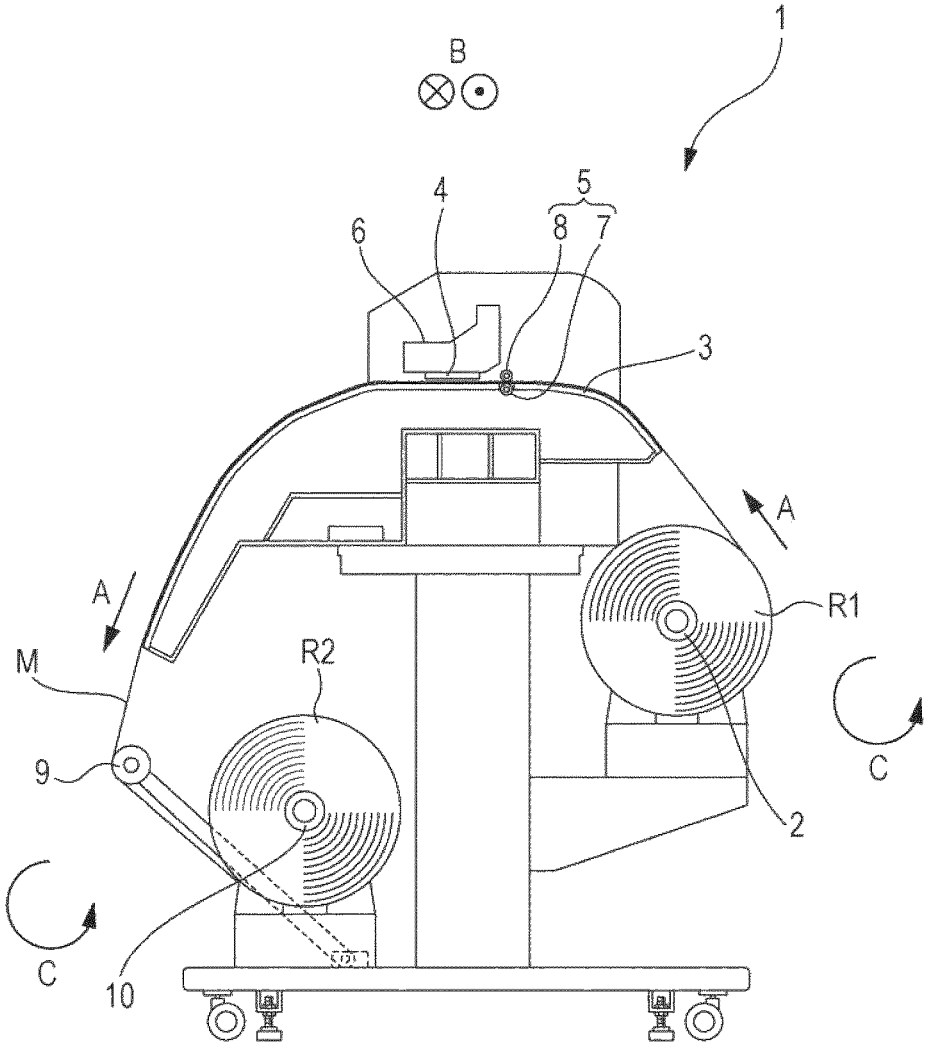
FIG. 1 is a schematic side view illustrating a recording apparatus according to an embodiment of the invention.

FIG. 1 is a schematic side view of a recording apparatus 1 according to the present embodiment.

The recording apparatus 1 according to the present embodiment includes a support shaft 2 that supports a roll R1 that is a subject recording medium (a medium) M in the form of a roll to be used for recording. In the recording apparatus 1 according to the present embodiment, the support shaft 2 rotates in a rotation direction C when the subject recording medium M is transported in a transportation direction A. Note that the present embodiment uses a subject recording medium M wound into a roll in such a way that a subject recording surface thereof is on the exterior, but in the case of using a subject recording medium M wound into a roll in such a way that a subject recording surface thereof is on the interior, the support shaft 2 can rotate in the direction opposite to the rotation direction C to feed the roll R1.

Furthermore, although the recording apparatus 1 according to the present embodiment uses the subject recording medium in the form of a roll as the subject recording medium M, the recording apparatus is not limited to such a recording apparatus that uses a subject recording medium in the form of a roll. For example, the recording apparatus may use a subject recording medium in cut sheets.

Furthermore, the recording apparatus 1 according to the present embodiment includes a transportation roller pair 5 including a drive roller 7 and driven rollers 8. The transportation roller pair 5 is used for transporting the subject recording medium M in the transportation direction A along a transportation path for the subject recording medium M. The transportation path includes a medium support 3 or the like.

Note that in the recording apparatus 1 according to the present embodiment, the drive roller 7 is one roller that extends in a direction B intersecting the transportation direction A of the subject recording medium M, and the driven rollers 8 are arranged in the direction B, opposite the drive roller 7.

The recording apparatus 1 according to the present embodiment is a recording apparatus including a moving unit (the transportation roller pair 5) that transports the subject recording medium M in the transportation direction A relative to a recording head 4. It is, however, sufficient that the moving unit be a unit that moves the subject recording medium M and an ejector relative to each other. Thus, the recording apparatus 1 may be what is called a flatbed recording apparatus which moves the ejector relative to the subject recording medium M.

Note that a heater capable of heating the subject recording medium M supported by the medium support 3 (not illustrated in the drawings) is provided below the medium support 3. Although the recording apparatus 1 according to the present embodiment includes the heater capable of heating the subject recording medium M from the medium support 3 side, the recording apparatus 1 may include an infrared heater or the like opposite the medium support 3.

The recording apparatus 1 according to the present embodiment further includes the recording head 4 and a carriage 6 on which the recording head 4 is mounted. The recording head 4 has a nozzle surface on which nozzles are provided and records data by ejecting ink from the nozzles. The carriage 6 is capable of reciprocating in the direction B.

Furthermore, a winding shaft 10 capable of winding up the subject recording medium M into a roll R2 is provided downstream of the recording head 4 in the transportation direction A of the subject recording medium M. Note that in the present embodiment, the subject recording medium M is wound up in such a way that the subject recording surface is on the exterior, and therefore the winding shaft 10 rotates in the rotation direction C when the subject recording medium M is wound up. In the case of winding up the subject recording medium M in such a way that the subject recording surface is on the interior, the winding shaft 10 can rotate in the direction opposite to the rotation direction C when the subject recording medium M is wound up.

Furthermore, a tension bar 9 is provided between the winding shaft 10 and a downstream end of the medium support 3 in the transportation direction A of the subject recording medium M. A part of the tension bar 9 that comes into contact with the subject recording medium M extends in the direction B. The tension bar 9 is capable of providing desired tension to the subject recording medium M.

Next, an electrical configuration of the recording apparatus 1 according to the present embodiment will be described.

Figure 2:
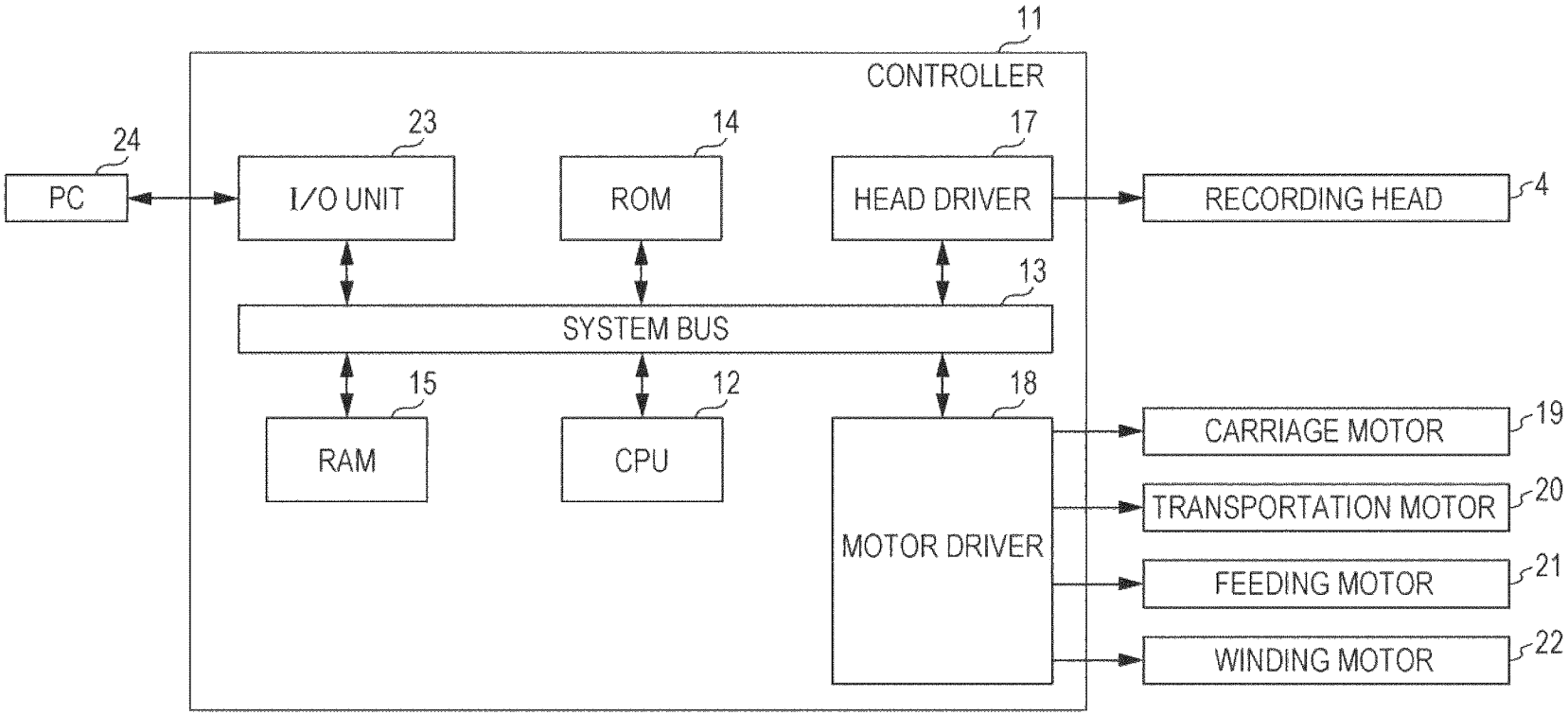
FIG. 2 is a block diagram of a recording apparatus according to an embodiment of the invention.

FIG. 2 is a block diagram of the recording apparatus 1 according to the present embodiment.

The controller 11 includes a CPU 12 that controls the entire recording apparatus 1. The CPU 12 is connected to a read-only memory (ROM) 14 and a random-access memory (RAM) 15 via a system bus 13. Various control programs or the like which are executed by the CPU 12 are stored in the ROM 14. Data can be temporarily stored in the RAM 15.

Furthermore, the CPU 12 is connected to a head driver 17 via the system bus 13. The head driver 17 is used for driving the recording head 4.

Furthermore, the CPU 12 is connected to a motor driver 18 via the system bus 13. The motor driver 18 is connected to a carriage motor 19, a transportation motor 20, a feeding motor 21, and a winding motor 22.

The carriage motor 19 is used for moving, in the direction B, the carriage 6 on which the recording head 4 is mounted. The transportation motor 20 is used for driving the drive roller 7 included in the transportation roller pair 5. The feeding motor 21 is a mechanism for rotating the support shaft 2 and drives the support shaft 2 to feed the subject recording medium M to the transportation roller pair 5. The winding motor 22 is a drive motor for rotating the winding shaft 10.

Furthermore, the CPU 12 is connected to an input/output (I/O) unit 23 via the system bus 13. The I/O unit 23 is connected to a personal computer (PC) 24 for transmitting and receiving data, such as recording data, and signals.

With the configuration described above, the controller 11 according to the present embodiment is capable of controlling the recording head 4 serving as the ejector, the drive roller 7 serving as the transportation roller included in the transportation unit, the carriage 6, and the like.

The controller 11 controls the recording head 4, the drive roller 7, the carriage 6, and the like to alternately and repeatedly transport a predetermined length of the subject recording medium M and eject ink while the recording head 4 is moved in the direction B. With this, recording can be executed.

Next, the recording head 4 according to the present embodiment will be described.

Figure 3:
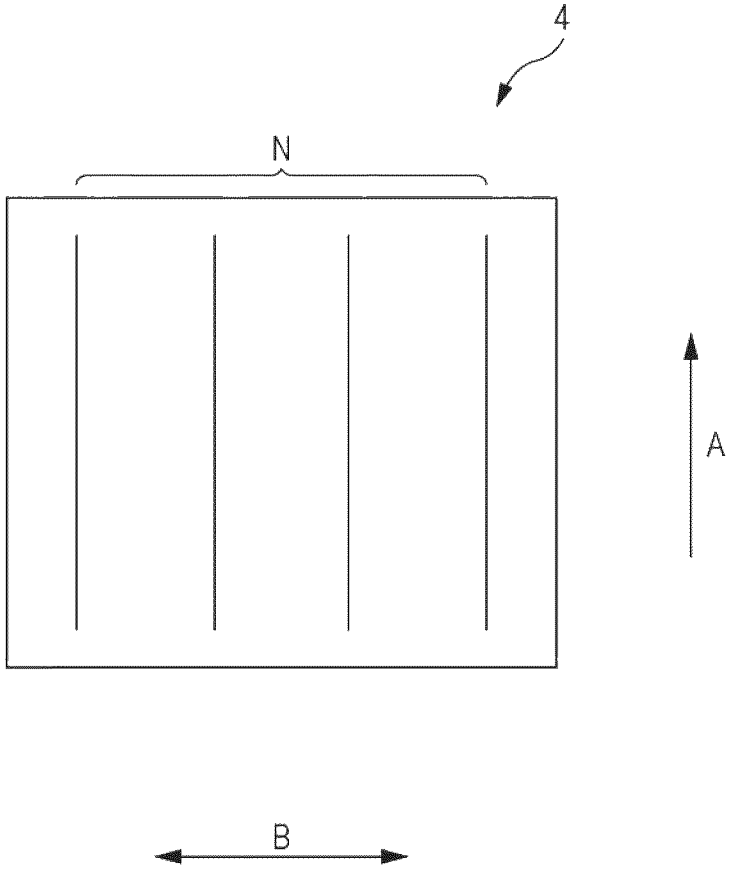
FIG. 3 is a schematic bottom view illustrating a recording head of a recording apparatus according to an embodiment of the invention.

FIG. 3 is a bottom view of the recording head 4 according to the present embodiment.

The recording head 4 according to the present embodiment has a nozzle array N that ejects ink which is an example of the liquid, as illustrated in FIG. 3. The nozzle array N includes nozzles arranged in the transportation direction A. The recording head 4 according to the present embodiment is configured to be able to reciprocate together with the carriage 6 in the direction B which is the first direction intersecting the nozzle array N.

Note that the transportation direction A intersecting the direction B, which is the first direction, corresponds to the second direction.

Next, the adjustment pattern P for the position of ink ejection by the recording apparatus 1 according to the present embodiment will be described.

Figure 4:
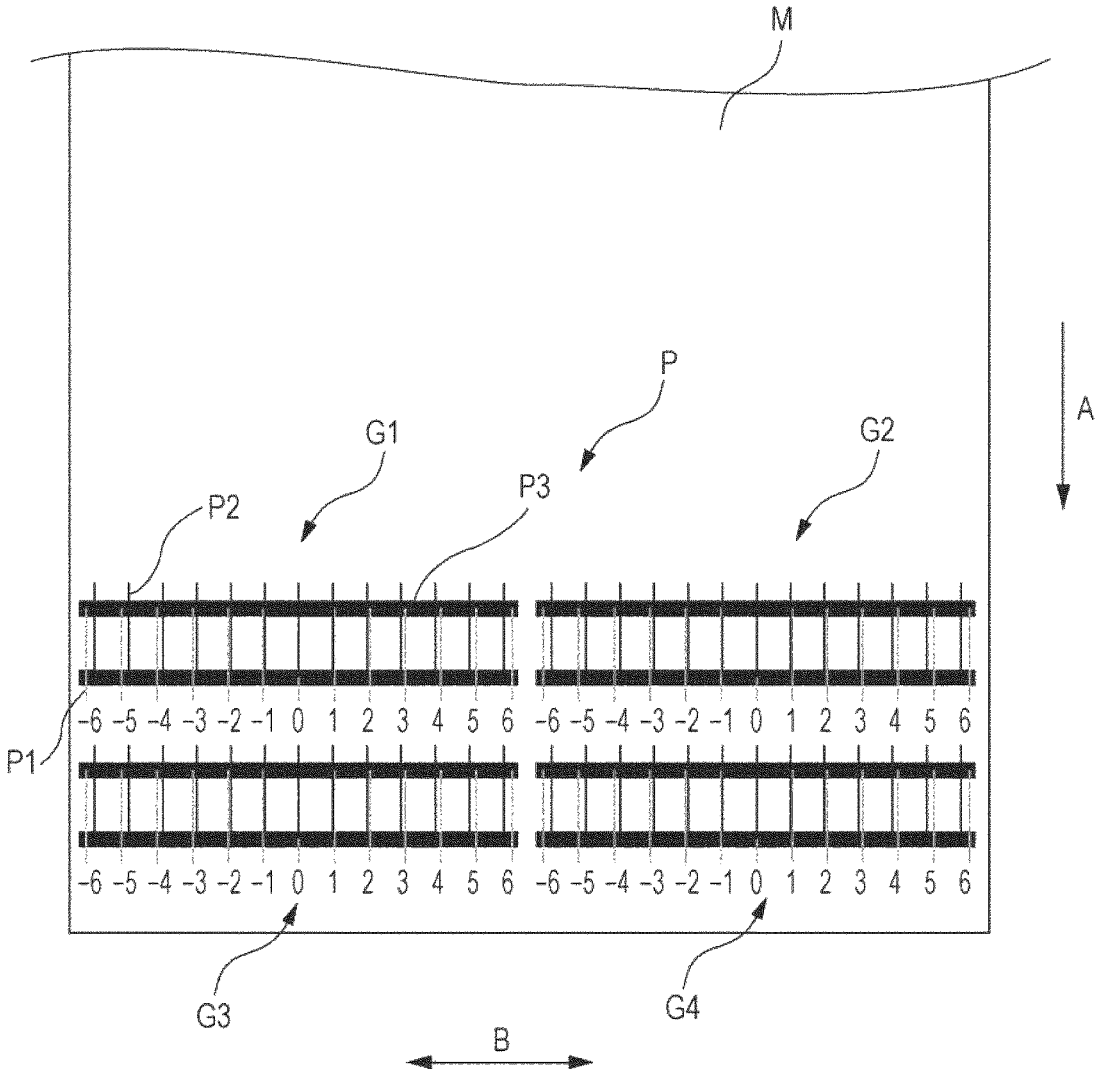
FIG. 4 is a schematic view illustrating adjustment patterns formed by a recording apparatus according to an embodiment of the invention.

FIG. 4 is a schematic overall view of the adjustment pattern P formed by the recording apparatus 1 according to the present embodiment.

Figure 5C:
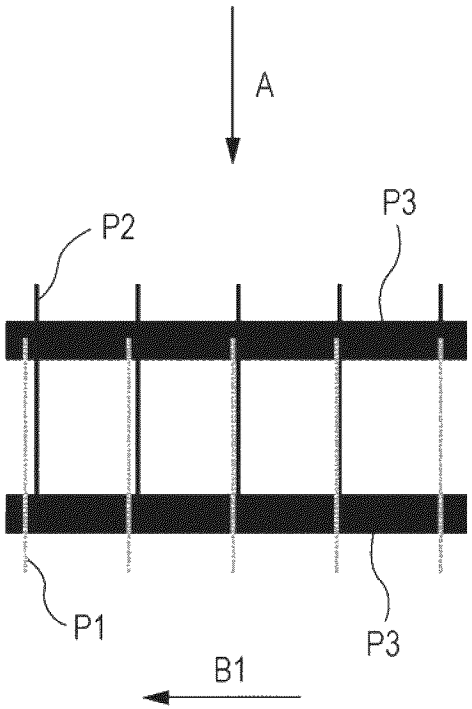
FIGS. 5A to 5C are schematic views illustrating adjustment patterns formed by a recording apparatus according to an embodiment of the invention.
Figure 5B:
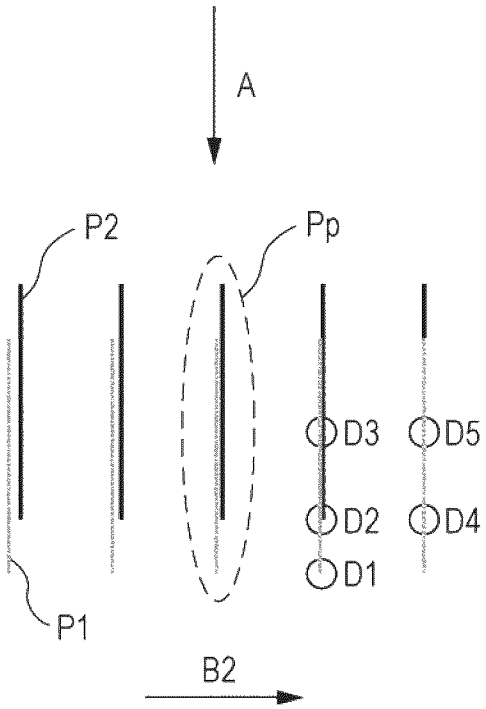
Figure 5A:
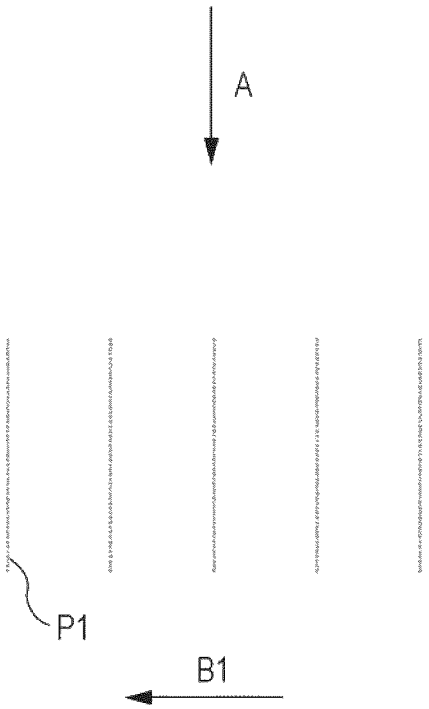
Figure 6A:
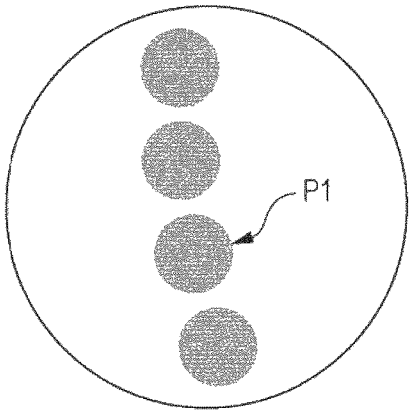
FIGS. 6A to 6E are schematic views illustrating adjustment patterns formed by a recording apparatus according to an embodiment of the invention.
Figure 6B:
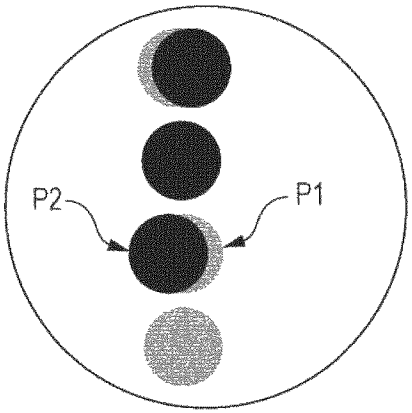
Figure 6C:
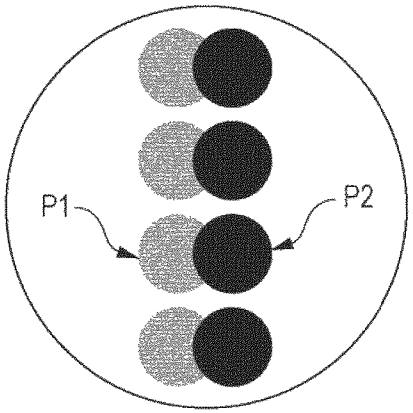
Figure 6D:
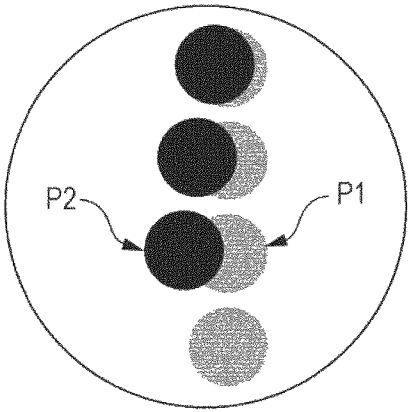
Figure 6E:
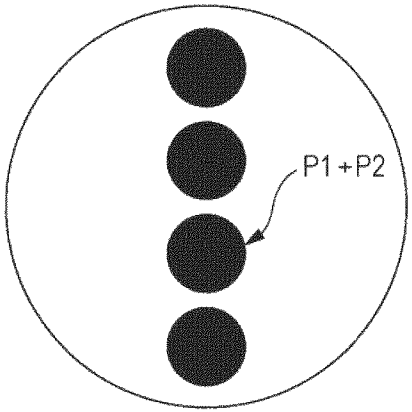
Figure 6E:
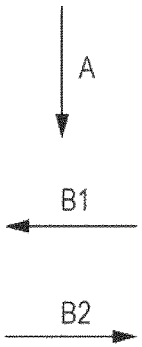
Figure 7:
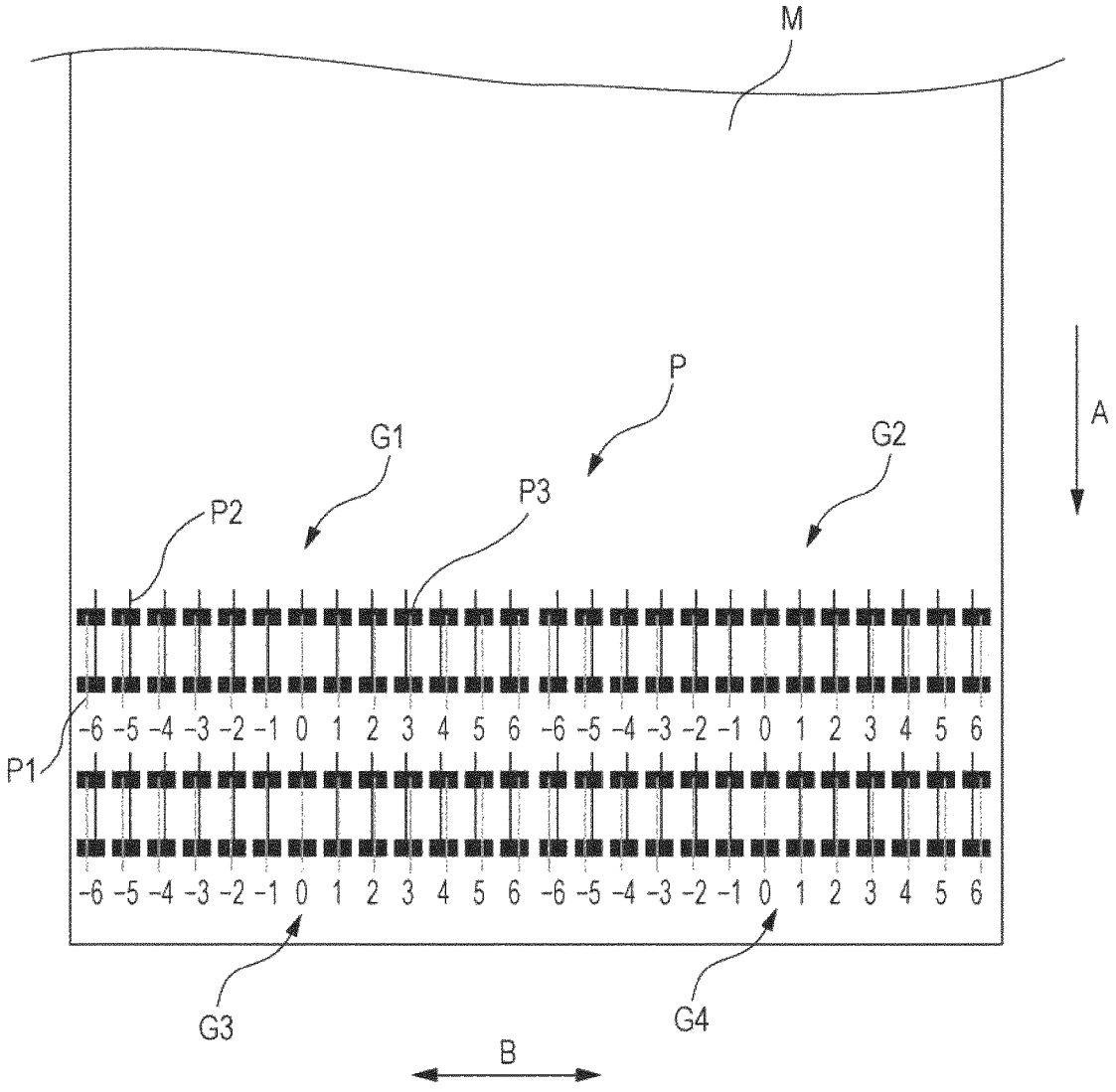
FIG. 7 is a schematic view illustrating adjustment patterns formed by a recording apparatus according to an embodiment of the invention.

FIGS. 5A to 5C each illustrate a part of the adjustment pattern P in detail. FIGS. 6A to 6E each include an enlarged view of area D1 in FIG. 5B (FIG. 6A), an enlarged view of area D2 in FIG. 5B (FIG. 6B), an enlarged view of area D3 in FIG. 5B (FIG. 6C), an enlarged view of area D4 in FIG. 5B (FIG. 6D), and an enlarged view of area D5 in FIG. 5B (FIG. 6E). FIG. 7 is a schematic overall view of an adjustment pattern P different from the adjustment patterns P illustrated in FIGS. 4 to 6E and corresponds to FIG. 4.

The recording apparatus 1 according to the present embodiment is capable of forming images (ejecting ink) by both outward B1 and backward B2 movements during the reciprocation of the recording head 4 in the direction B. The adjustment pattern P according to the present embodiment is what is called a reciprocating adjustment pattern for adjusting the position of ink ejection by the backward B2 movement of the recording head 4 relative to the position of ink ejection by the outward B1 movement of the recording head 4.

When ejecting ink from the recording head 4, the recording apparatus 1 according to the present embodiment is capable of changing the dot diameter of ink (the amount of ink) to be ejected from the nozzle array N and is also capable of changing the frequency of ejection of ink to be ejected from the nozzle array N (the ink ejection timing). In other words, the recording apparatus 1 according to the present embodiment is capable of ejecting ink in large dots and in small dots and is also capable of ejecting ink at a high frequency of ejection and at a low frequency of ejection.

Accordingly, the adjustment pattern P can be formed into adjustment patterns P in four groups, as illustrated in FIG. 4. Specifically, among the adjustment patterns P, the adjustment pattern P in group G1 is a pattern formed in large dots at a high frequency of ejection, the adjustment pattern P in group G2 is a pattern formed in small dots at a high frequency of ejection, the adjustment pattern P in group G3 is a pattern formed in large dots at a low frequency of ejection, and the adjustment pattern P in group G4 is a pattern formed in small dots at a low frequency of ejection. Note that the adjustment patterns P in groups G1 to G4 are formed in similar ways; the adjustment patterns P in groups G1 and G2 are formed by the same reciprocation of the recording head 4, and the adjustment patterns P in groups G3 and G4 are formed by the same reciprocation of the recording head 4.

The adjustment patterns P in groups G1 to G4 are each formed as described below.

First, as illustrated in FIG. 5A, first patterns P1 are formed in a first direction on the subject recording medium M while the recording head 4 is moved in the outward B1 direction.

Next, as illustrated in FIG. 5B, second patterns P2 are formed in one-to-one correspondence with the first patterns P1 with different first amounts of interval in the first direction from the first patterns P1 while the recording head 4 is moved in the backward B2 direction in the first direction. Note that FIG. 5B shows that a pattern set Pp (a pattern pair including one of the first patterns P1 and one of the second patterns P2 that correspond to each other) at the rightmost position has the smallest interval in the direction B (the first direction) between the first pattern P1 and the second pattern P2 and that the interval in the direction B between the first pattern P1 and the second pattern P2 in the pattern set Pp is greater as the pattern set Pp is located further leftward.

Subsequently, as illustrated in FIG. 5C, a third pattern P3 is formed in an end region that is at least a part of an end of the first patterns P1 in the second direction and at least a part of an end of the second patterns P2 in the second direction.

Note that "an end region that is at least a part of an end of the first patterns P1 in the second direction and at least a part of an end of the second patterns P2 in the second direction" means a region in the end or adjacent to the end, rather than at the end, of the first patterns and the second patterns in the second direction; this may or may not include the end. The correspondence between B1 and B2 in the figure and the outward and backward movements of the recording head 4 may be reversed.

The adjustment pattern P according to the present embodiment is used to set an adjustment value for reciprocation adjustment on the basis of interval conditions (ejection timing) used to form a pattern set Pp in which the amount of interval in the first direction is smallest among the pattern sets Pp each including one of the first patterns P1 and one of the second patterns P2 that correspond to each other. A detailed description of how to set an adjustment value for reciprocation adjustment will be given below.

As illustrated in FIG. 4, numbers −6 to +6 are assigned to the pattern sets Pp each including one of the first patterns P1 and one of the second patterns P2 that correspond to each other in each of the adjustment patterns P in groups G1 to G4.

A user can visually check an enlarged image of the pattern sets Pp assigned with the numbers −6 to +6 through a magnifying glass to select a pattern set Pp in which the amount of interval in the first direction is smallest, and use a user interface or the like (including a mouse and a keyboard on the PC 24 and a touch panel on the recording apparatus 1) (not illustrated in the drawings) to input the number assigned to the selected pattern set Pp.

The controller 11 sets an adjustment value for reciprocation adjustment on the basis of the value of the number input by the user.

Generally, the speed of ink ejection forming an end of the adjustment pattern P tends to be lower than the speed of ink ejection forming other parts of the adjustment pattern P. Therefore, there may be a decrease in the accuracy of reciprocation adjustment if a pattern set Pp in which the amount of interval in the first direction is smallest is selected from among the pattern sets Pp each including one of the first patterns P1 and one of the second patterns P2 that correspond to each other.

Area D1 in FIG. 5B is an end region of the first pattern P1 included in the pattern set Pp in which the amount of interval is not smallest. FIG. 6A is an enlarged view of area D1.

Area D2 in FIG. 5B is a non-end region of the first pattern P1 and an end region of the second pattern P2 included in the pattern set Pp in which the amount of interval is not smallest. FIG. 6B is an enlarged view of area D2.

Area D3 in FIG. 5B is a non-end region of the first pattern P1 and a non-end region of the second pattern P2 included in the pattern set Pp in which the amount of interval is not smallest. FIG. 6C is an enlarged view of area D3.

Area D4 in FIG. 5B is a non-end region of the first pattern P1 and an end region of the second pattern P2 included in the pattern set Pp in which the amount of interval is smallest. FIG. 6D is an enlarged view of area D4.

Area D5 in FIG. 5B is a non-end region of the first pattern P1 and a non-end region of the second pattern P2 included in the pattern set Pp in which the amount of interval is smallest. FIG. 6E is an enlarged view of area D5.

Note that in FIGS. 6A to 6C, ink dots forming the first pattern P1 are gray and ink dots forming the second pattern P2 are black such that they can be easily visually distinguished from each other.

As illustrated in FIG. 6A, the ink dots for the end region of the first pattern P1 that are landing closer to an end of the first pattern P1 are misaligned further rearward in the outward B1 direction because the speed of ejection of the ink dots decreases toward the end. As illustrated in FIGS. 6B and 6D, the ink dots for the end region of the second pattern P2 that are landing closer to an end of the second pattern P2 are misaligned further rearward in the backward B2 direction because the speed of ejection of the ink dots decreases toward the end.

As described above, the pattern sets Pp corresponding to area D4 and area D5 have the smallest amount of interval; the amount of interval in the pattern sets Pp corresponding to area D1, area D2, and area D3 is not smallest.

This is clear from a comparison between FIG. 6C and FIG. 6E corresponding to area D3 and area D5, respectively, each of which is a non-end region of the first pattern P1 and a non-end region of the second pattern P2.

On the other hand, in a comparison between FIG. 6B and FIG. 6D corresponding to area D2 and area D4, respectively, each of which is a non-end region of the first pattern P1 and an end region of the second pattern P2, the amount of interval in area D2 included in the pattern set Pp in which the amount of interval is not smallest is smaller than the amount of interval in area D4 included in the pattern set Pp in which the amount of interval is smallest, if focus is given to this part only.

Therefore, there may be a decrease in the accuracy of reciprocation adjustment as a result of selecting a pattern set Pp in which the amount of interval in an end region of the first pattern P1 and an end region of the second pattern P2 is smallest.

As described above, the recording apparatus 1 according to the present embodiment includes the recording head 4 having the nozzle array N that ejects ink and that is capable of reciprocating in the first direction (the direction B) intersecting the nozzle array N; and the transportation roller pair 5 that transports the subject recording medium M in the second direction (the transportation direction A) intersecting the first direction. The controller 11 causes the recording head 4 to eject ink to form the first patterns P1 in the first direction on the subject recording medium M while moving the recording head 4 in the outward B1 direction, form the second patterns P2 in one-to-one correspondence with the first patterns P1 with different first amounts of interval in the first direction from the first patterns P1 while moving the recording head 4 in the backward B2 direction, and form the third pattern P3 in the end region that is at least a part of an end of the first patterns P1 in the second direction and at least a part of an end of the second patterns P2 in the second direction.

With this, an adequate adjustment pattern check position (an area that is a non-end region of the first pattern P1 and a non-end region of the second pattern P2) can be recognized with reference to the third pattern P3. Thus, with this configuration, the recording apparatus 1 according to the present embodiment is capable of inhibiting a decrease in the adjustment accuracy depending on the check position in the adjustment pattern P.

As illustrated in FIGS. 4 and 5, the third pattern P3 according to the present embodiment covers the end region of the first patterns P1 and the end region of the second patterns P2. The third pattern P3 is a visibility decrease pattern which decreases visibility of the first patterns P1 and the second patterns P2 in the end region. This means that with this configuration, the recording apparatus 1 according to the present embodiment covers an inadequate check position in the adjustment pattern P with the third pattern P3 such that a decrease in the adjustment accuracy depending on the check position in the adjustment pattern P can be accurately inhibited.

Note that the third pattern P3 is not limited to a pattern that covers the end region. This is because a non-end region on which the third pattern P3 is not formed (an adequate adjustment pattern check position) can be recognized when the third pattern P3 is formed on the end region.

In the recording apparatus 1 according to the present embodiment, the controller 11 causes the third pattern P3, which serves as the visibility decrease pattern, to be formed in a color identical to at least one of the color of the first patterns P1 and the color of the second patterns P2. Specifically, all the first patterns P1, the second patterns P2, and the third pattern P3 are formed in black. Thus, with this configuration, the recording apparatus 1 according to the present embodiment is capable of securely covering an inadequate check position in the adjustment pattern P with the third pattern P3.

Furthermore, in the recording apparatus 1 according to the present embodiment, the controller 11 causes the third pattern P3, which serves as the visibility decrease pattern, to be formed as a line extending in the first direction, as illustrated in FIGS. 4 and 5. Thus, with this configuration, the recording apparatus 1 according to the present embodiment is capable of securely covering an inadequate check position in the adjustment pattern P by simply controlling the ejection.

The third pattern P3, which serves as the visibility decrease pattern, is not limited to being in the form of a line, and may be, for example, in the form of a block, as illustrated in FIG. 7.

Furthermore, in the recording apparatus 1 according to the present embodiment, the controller 11 forms pattern groups (groups G1 to G4) each including two or more of the first patterns and two or more of the second patterns that correspond to each other and causes the third pattern P3, which serves as the visibility decrease pattern, to be formed as a line for each of the pattern groups, as illustrated in FIG. 4. With this, in the recording apparatus 1 according to the present embodiment, the visibility decrease pattern combines corresponding patterns together as a pattern group such that recognition of each pattern group is made easier.

Furthermore, in the recording apparatus 1 according to the present embodiment, the controller 11 causes a mark which is a number in the range −6 to +6 to be formed for each pattern set Pp including one of the first patterns P1 and one of the second patterns P2 that correspond to each other, as illustrated in FIG. 4. Thus, the recording apparatus 1 according to the present embodiment allows a user to select a desired pattern set Pp from among pattern sets Pp and input the selected pattern set Pp by using a user interface or the like. With this configuration, the desired pattern set Pp can be easily recognized in association with a number, and it is possible to easily input a desired number.

Furthermore, in the recording apparatus 1 according to the present embodiment, the controller 11 causes the third pattern P3 to be formed such that at least one of the first pattern P1 and the second pattern P2 protrudes toward the mark through the third pattern P3, as illustrated in FIG. 4. With this configuration, the recording apparatus 1 according to the present embodiment allows the correspondence between a desired pattern set Pp and a mark to be easily recognized.

Furthermore, in the adjustment pattern P according to the present embodiment, the first patterns P1 and the second patterns P2 are equal in length in the second direction. With this, the amounts of ink ejected for the first patterns P1 and the second patterns P2 are equalized, resulting in a reduction of errors in the ink-landing position upon forming the adjustment pattern P which would be due to variations in the amount of ink ejected for the first patterns P1 and the second patterns P2.

Note that "equal" herein means substantially the same or substantially equal, in other words, it is not necessary to be exactly equal.

Furthermore, each pattern set Pp including one of the first patterns P1 and one of the second patterns P2 that correspond to each other has point symmetry, as illustrated in FIGS. 4 and 5. This means that each pattern set Pp has the same shape before and after being rotated 180 degrees about the center thereof.

With this, simple patterns that are easy for users to see are made.

The following will describe an embodiment of the method of forming an adjustment pattern check area by using the recording apparatus 1 according to the present embodiment.

Figure 8:
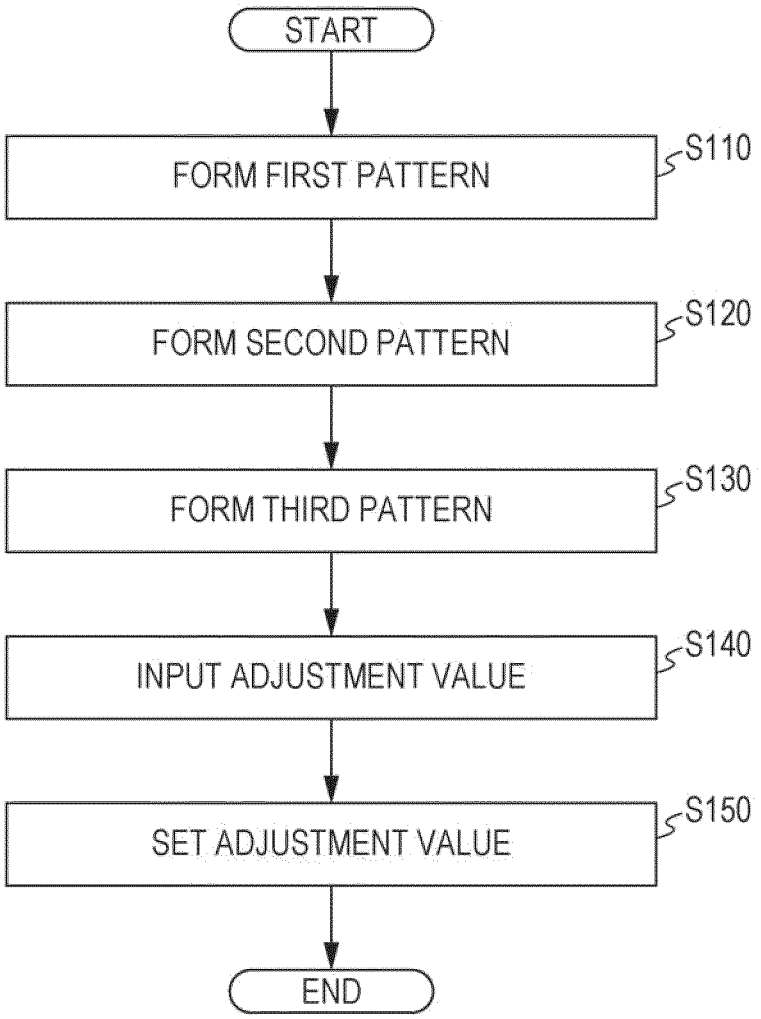
FIG. 8 is a flowchart illustrating a method of adjusting an ejection position according to an embodiment of the invention.

FIG. 8 is a flowchart of a method of adjusting an ejection position according to the present embodiment.

When the method of adjusting an ejection position according to the present embodiment is started, for example, in response to an instruction from a user, first, in Step S110, the recording head 4 is caused to eject ink to form the first patterns P1 in the first direction on the subject recording medium M while the recording head 4 is moved in the outward B1 direction.

Next, in Step S120, the second patterns P2 are formed in one-to-one correspondence with the first patterns P1 with different first amounts of interval in the first direction from the first patterns P1 while the recording head 4 is moved in the backward B2 direction.

Next, in Step S130, the third pattern P3 is formed in the end region that is at least a part of an end of the first patterns P1 in the second direction and at least a part of an end of the second patterns P2 in the second direction.

Next, in Step S140, a user selects a pattern set Pp in which the amount of interval between the first pattern P1 and the second pattern P2 is smallest from among the pattern sets Pp each including one of the first patterns P1 and one of the second patterns P2 that correspond to each other in the adjustment pattern P including the first pattern P1, the second pattern P2, and the third pattern P3. Subsequently, the user inputs a mark corresponding to the selected pattern set Pp. In other words, the user inputs an adequate adjustment value based on the selected pattern set Pp.

Next, in Step S150, the controller 11 sets an ejection timing (an adjustment value) on the basis of an input result of Step S140.

To put it another way, the method of forming an adjustment pattern check area according to the present embodiment is a method of forming an adjustment pattern check area by using the recording apparatus 1 including: the recording head 4 having the nozzle array N that ejects ink and that is capable of reciprocating in the first direction (the direction B) intersecting the nozzle array N; and the transportation roller pair 5 that transports the subject recording medium M (that moves the subject recording medium M and the recording head 4 relative to each other) in the second direction (the transportation direction A) intersecting the first direction. The recording head 4 is then caused to eject ink to form the first patterns P1 in the first direction on the subject recording medium M while the recording head 4 is moved in the outward B1 direction (Step S110), the second patterns P2 are formed in one-to-one correspondence with the first patterns P1 with different first amounts of interval in the first direction from the first patterns P1 while the recording head 4 is moved in the backward B2 direction (Step S120), and the third pattern P3 is formed in the end region that is at least a part of an end of the first patterns P1 in the second direction and at least a part of an end of the second patterns P2 in the second direction (Step S130).

The method of forming an adjustment pattern check area according to the present embodiment allows an adequate check position in the adjustment pattern P to be recognized with reference to the third pattern P3. With this, a decrease in the adjustment accuracy depending on the check position in the adjustment pattern P can be inhibited.

Note that the invention is not limited to the above embodiments; various modifications are possible within the scope of the invention recited in the accompanying claims, and it goes without saying that such modified embodiments are included in the scope of the invention.

This application claims priority under 35 U.S.C. §119 to Japanese Patent Application No. 2015-180444, filed Sep. 14, 2015. The entire disclosure of Japanese Patent Application No. 2015-180444 is hereby incorporated herein by reference.

What is claimed is:

1. A liquid ejecting apparatus, comprising:

an ejector having a nozzle array that ejects a liquid and that is capable of reciprocating in a first direction intersecting the nozzle array;

a moving unit that moves a medium and the ejector relative to each other in a second direction intersecting the first direction; and a controller that causes the ejector to eject the liquid to form first patterns in the first direction on the medium while moving the ejector outward in the first direction, form second patterns in one-to-one correspondence with the first patterns with different first amounts of interval in the first direction from the first patterns while moving the ejector backward in the first direction, and form a third pattern in an end region that is at least a part of an end of the first patterns in the second direction and at least a part of an end of the second patterns in the second direction.

2. The liquid ejecting apparatus according to claim 1, wherein the third pattern is a visibility decrease pattern which decreases visibility of the first patterns and the second patterns in the end region.

3. The liquid ejecting apparatus according to claim 2, wherein the controller causes the visibility decrease pattern to be formed in a color identical to at least one of a color of the first patterns and a color of the second patterns.

4. The liquid ejecting apparatus according to claim 2, wherein the controller causes the visibility decrease pattern to be formed as a line extending in the first direction.

5. The liquid ejecting apparatus according to claim 4, wherein the controller forms pattern groups each including two or more of the first patterns and two or more of the second patterns that correspond to each other and causes the visibility decrease pattern to be formed as a line for each of the pattern groups.

6. The liquid ejecting apparatus according to claim 1, wherein the controller causes a mark to be formed for each pattern set including one of the first patterns and one of the second patterns that correspond to each other.

7. The liquid ejecting apparatus according to claim 6, wherein the controller causes the third pattern to be formed such that at least one of the first pattern and the second pattern protrudes toward the mark through the third pattern.

8. The liquid ejecting apparatus according to claim 1, wherein the first patterns and the second patterns are equal in length in the second direction.

9. The liquid ejecting apparatus according to claim 8, wherein each pattern set including one of the first patterns and one of the second patterns that correspond to each other has point symmetry.

10. A method of forming an adjustment pattern check area by using a liquid ejecting apparatus including an ejector having a nozzle array that ejects a liquid and that is capable of reciprocating in a first direction intersecting the nozzle array; and a moving unit that moves a medium and the ejector relative to each other in a second direction intersecting the first direction, the method comprising:

causing the ejector to eject the liquid to form first patterns in the first direction on the medium while moving the ejector outward in the first direction;

form second patterns in one-to-one correspondence with the first patterns with different first amounts of interval in the first direction from the first patterns while moving the ejector backward in the first direction; and form a third pattern in an end region that is at least a part of an end of the first patterns in the second direction and at least a part of an end of the second patterns in the second direction.

* * * * *